United States Patent [19]

DaCosta et al.

[11] 4,261,484

[45] Apr. 14, 1981

[54] NON-RETURN VALVE UNIT WITH DRIP PREVENTION AND CONTROLLED DISCHARGE

[76] Inventors: Leonidio J. DaCosta, Praca de Alvalade; Jose M. Fonseca, Rua Cidade de Margao, both of Lisbon, Portugal

[21] Appl. No.: 62,953

[22] Filed: Aug. 2, 1979

[30] Foreign Application Priority Data

Aug. 2, 1978 [PT] Portugal ..... 68380[U]

[51] Int. Cl.[3] ..... B65D 49/02; B65D 25/40

[52] U.S. Cl. ..... 222/500; 222/571

[58] Field of Search ..... 215/21, 22; 222/567, 222/571, 500; 137/38, 533.21, 533.31

[56] References Cited

U.S. PATENT DOCUMENTS

| | | | |
|---|---|---|---|
| 1,320,904 | 11/1919 | O'Neill et al. | 215/21 |
| 1,861,396 | 5/1932 | Isbell | 137/533.21 X |
| 2,535,882 | 12/1950 | Villane et al. | 215/21 X |
| 3,311,275 | 3/1967 | Gibson | 222/567 |
| 3,484,819 | 12/1969 | Tanner | 222/500 X |
| 3,794,202 | 2/1974 | Unger | 222/500 X |

FOREIGN PATENT DOCUMENTS

| | | | |
|---|---|---|---|
| 341212 | 8/1904 | France | 215/22 |
| 2364168 | 12/1978 | France | 222/495 |
| 2908 | 1/1919 | Netherlands | 215/21 |

*Primary Examiner*—David A. Scherbel

*Attorney, Agent, or Firm*—Hopgood, Calimafde, Kalil, Blaustein & Lieberman

[57] ABSTRACT

A non-return valve unit for a bottle having a mechanism for preventing dripping and for giving a controlled discharge of liquid from the bottle, suitable for use with any type of bottle neck by insertion in the said neck and especially for bottles adapted to receive "pilfer-proof" caps. The valve unit consists of only three elements made up generally of a cylindrical slightly frusto-conical body having a brim for preventing dripping and having a septum in its interior where the seat of a generally circular valve is positioned. Radial septa which support an annular guide for the stem of a check or retention valve, form a component part of this septum. An upper chamber in the body houses a pouring device of a frusto-conical shape. The pouring device has a cylindrical wall internally supported by radial septa which ends in a frusto-conical surface; and provides together with the inner cylindrical surface of the pourer a circular area of discharge. The pouring device also provides guide ridges for guiding the movement of the upper stem of the retention valve which, on moving upward rests against the lower edge of the said inner cylindrical wall. The shape of the base of retention valve being the same as that of the inner frusto-conical surface to which the assembly is connected, providing, when the valve rises for the discharge of the liquid by tilting the bottle with the inner wall of the pourer, a discharge circular space allowing a controlled discharge free of turbulence.

7 Claims, 16 Drawing Figures

NON-RETURN VALVE UNIT WITH DRIP PREVENTION AND CONTROLLED DISCHARGE

Figure 1:
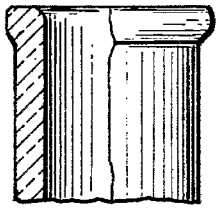
PRIOR ART FIG. 1

There are already known non-return valves for use in the necks of bottles, in order to guarantee that the liquid contained in the bottles has not been adulterated. However, such valves known to date, have certain drawbacks given the various requirements which they must satisfy.

In fact, a valve of the type in question must, first of all, be perfectly inviolable, that is, must not permit, under any circumstances, the introduction of any liquid into the bottle in which it is inserted. In addition, the valve must allow a reasonable and controlled discharge of liquid from the bottle, since generally such valves are used in bottles containing spirits or alcoholic beverages which are usually served in small individual doses. Therefore, the discharge given by the valve is important for the convenient and efficient use of the bottle in which it is used. In addition, it is desirable to include a device which will prevent the running of liquid down the bottle since this can affect the repeated dispensing of the liquid contained in the bottle.

Another desirable property of the valve is that removal of the valve from the bottle must only be possible by irreversible destruction of the valve or its components, the fraudulent removal of which is thus made evident to the consumer.

Finally, the valve must be of an economical manufacture, and must be easy to apply and insert into the top of the bottle.

Valves which simultaneously and efficiently satisfy all the aforementioned requirements are not known.

Despite the existence of some valves of the above type that are strictly inviolable, such valves are made up of a large number of components, the insertion system of the valve in the neck of the bottle contributing to that large number (usually never under five). This requires necks of special shapes as for example those represented by FIG. 1 of the accompanying drawings and which implies the existence of an arresting belt of the valve in aluminium or plastic. The machines to apply such a belt and to manufacture and assemble the valves are expensive, they require tuning and are of delicate functioning.

Therefore, generally to manufacture this type of known valve, the assembly of the valves is slow because they usually comprise 5, 6 and sometimes even 7 elements; it is expensive because it requires that the manufacturer has simultaneously at his disposal, for a good labour return results, a number of injector machines at least equal to the number of the plastic components which comprise the valve.

Finally, the outer irregular geometry of the known valves, and their size, impose difficulty in their packing which has to be made in bulk with a low number of pieces to a container.

With this invention it is intended to avoid the inconveniences aforementioned, offering a valve that possesses the following characteristics:

(a) Effectively inviolable, that is, practically does not permit the introduction of any liquid into the bottle on which it is used and may not be removed unless the valve is destroyed.

(b) Of easy and economical manufacture and composed of a small number of parts. In the case of this invention it consists of only three elements.

(c) Does not require a special type of bottle neck; can be applied to any shape of neck, as can be seen by the description which follows, since the valve is fully inserted into the bottle neck.

(d) Its size and outer geometrical form permit easy and economical packing. In the case of this invention, as will be seen later on, the outer shape of the valve is practically cylindrical, which provides an ideal form for packing, due to its outer dimensions, much smaller of those known valves, since after its full insertion it is incorporated in the bottle neck.

(e) Finally, the system of inviolability will not interfere with the existence of a minimum discharge flow of the liquid contained in the bottle, that is, the system, besides being efficient must permit a discharge that will not cause an excessively slow service in handling normal doses of the beverage.

The valve, according to the present invention, fulfils the aforementioned conditions, other advantages and characteristics being made evident by the detailed description which follows.

Figure 2:
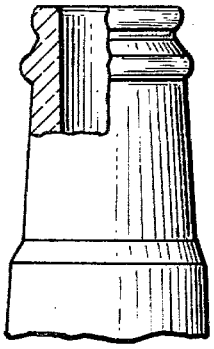
PRIOR ART FIG. 2
Figure 2A:
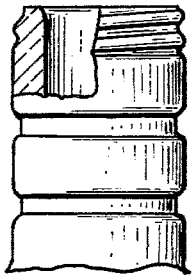
PRIOR ART FIG. 2a
Figure 2B:
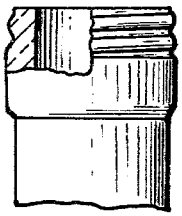
PRIOR ART FIG. 2b
Figure 3:
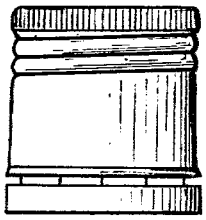
PRIOR ART FIG. 3
Figure 4:
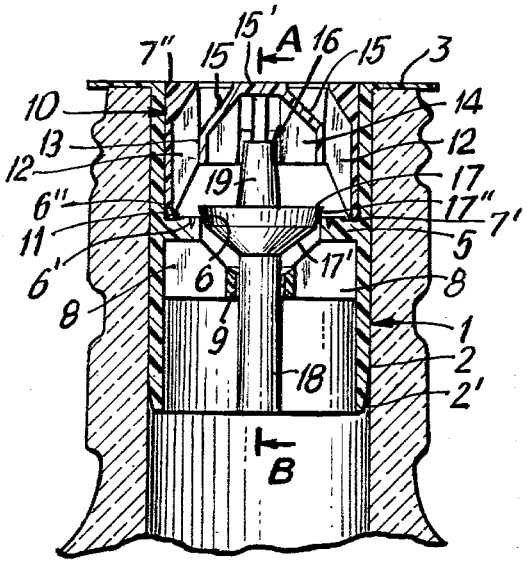
Figure 5:
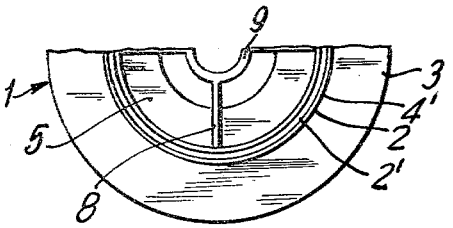
Figure 6:
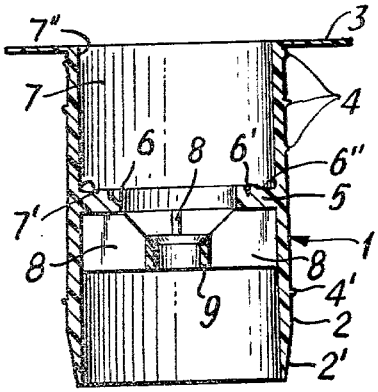
Figure 7:
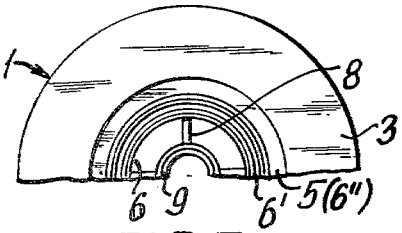
Figure 8:
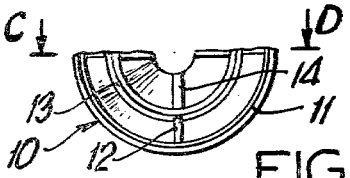
Figure 9:
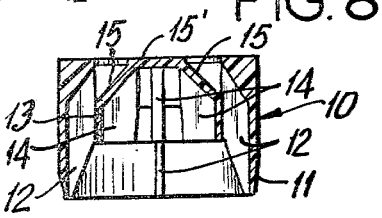
Figure 10:
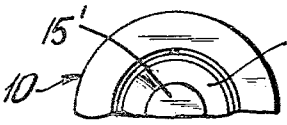
Figure 11:
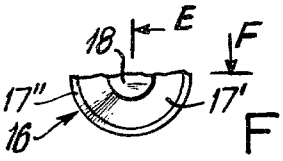
Figure 12:
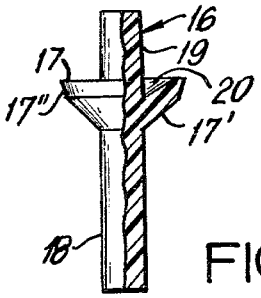
Figure 13:
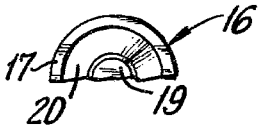
Figure 14:
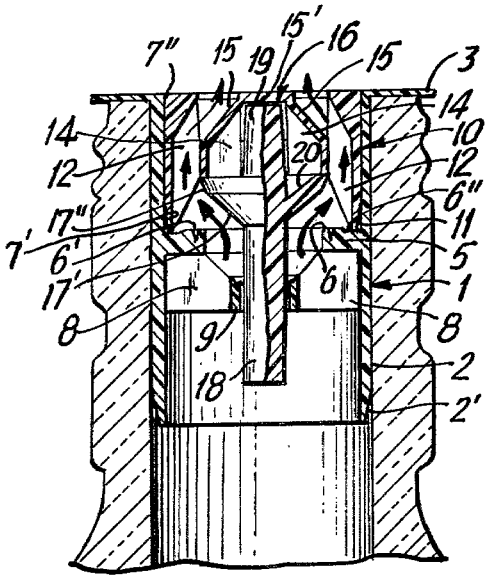

One embodiment of the present invention will now be described, by way of example only, with reference to the accompanying drawings, in which:

FIG. 1 is a side view and a partial section of two types of bottle necks designed for use with known non-return valves, FIGS. 2, 2*a* and 2*b* are side views and partial section views of two types of bottle necks designed for use with capsules or stoppers of the type generally known as "pilfer proof", FIG. 3 is an elevation of a stopper or capsule of the "pilfer proof" type, FIG. 4 is an elevation, shown partly in section, of an embodiment of the valve unit according to the present invention, assembled in the bottle neck of a bottle with the check valve in the closed position, FIG. 5 is a partial view of the underside of the body of the valve unit of FIG. 4, FIG. 6 is a sectional view, taken along line AB of FIG. 4, of the body of the valve unit, FIG. 7 is a partial plan view of the body of the valve unit of FIG. 4, FIG. 8 is a partial plan view of the pourer of the valve unit of FIG. 4, FIG. 9 is a section, taken along line CD of FIG. 8, of the pourer, FIG. 10 is a partial underside view of the pourer of the valve unit of FIG. 4, FIG. 11 is a partial view of the check valve of the valve unit of FIG. 4, FIG. 12 is an elevation, partly in section taken along line EF of FIG. 10, of the check valve, FIG. 13 is an underside partial view of the check valve of FIG. 10, FIG. 14 is a view identical to FIG. 4 but showing the check valve fully opened.

As previously referred to, a non-return valve unit of the present invention can be applied to any type of bottle neck and, to a certain degree, is independent of the type of the bottle stopper or top used on the bottle, since it is placed in the bottle neck by fully inserting it into the neck as if it were a stopper.

The embodiment described below is especially intended for use in bottles which use the classic "pilfer proof" top, that is, a threaded aluminium stopper, connected by way of links to an under skirt fastened around one or more folds found in the bottle neck as seen in FIG. 3.

This type of bottle top is the one mostly used in bottling spirits and alcoholic beverages. These products, due to their nature and cost, are more susceptible to adulteration, hence the very special interest in the direct application of the present invention to this type of bottle top, since the inviolable valves of former shapes require special-type bottle necks, examples of which are given in FIG. 1. This implies the necessity of a special bottle top, consequently resulting in the need for specially manufactured bottles to agree with the chosen inviolable unit. Over and above all the inconveniences, by using any of the known inviolable valve units, the cost is greatly affected.

With the inviolable valve unit of the present invention, besides eliminating the disadvantages mentioned, it is possible to manufacture a valve unit at a much lower price per unit in comparison with known units.

As may be seen from the accompanying drawings the universal valve unit of the invention essentially consists of three main parts; the body of the unit (1), shown individually in FIGS. 5 to 7, the pouring device (10) represented in FIGS. 8 to 10, and the retention valve (16) represented in FIGS. 11 to 13.

The body (1) of the unit which may be better seen in FIG. 6, has a slightly frusto-conical outer shape, so that once it is inserted in the bottles neck it acquires a conical form which prevents the possible removal of the entire unit. The lower extremity of the body (1) ends in a cylindrical wall (2) followed followed by a frusto-conical wall (2') intended to facilitate the insertion of the unit in the bottles neck, the outer diameter of the lowest part of the body (1) being smaller than the nominal diameter of the neck of the bottle.

In its upper part, the body (1) has a peripheral brim (3) which is part of a plane extending normally to the axis of the body (1), the purpose of the brim being to avoid the formation of drops of the liquid. As is known, the formation of drops is caused by the adherence of liquid to the outer walls of the bottles neck. According to the present invention by means of the brim (3) it is possible to cut through the level of the liquid when the bottle is tilted vertically to empty the liquid contained therein.

According to the invention, the body thus placed, makes it possible to entirely eliminate the formation of the drops thus greatly facilitating the use of the liquid contained in the bottle.

The brim (3), being an integral part of the body (1) which is suitably made of low density polyethylene, has a high degree of elasticity, and further contributes to a good sealing of the bottle top or capsule.

The outer surface of the body (1) has several peripheral ridges (4, 4') which are are intended to cause adherence to the inner smooth surface of the bottle top and contribute to the fastening of the valve unit. It should be noted that although the number of peripheral ridges may be arbitrary their distribution should be such that there are no ridges in the immediate vicinity of the level of a septum (5) on the inside of the body (1). This is because once the adjustment of the non-return valve unit to the inner surface of the bottle top by means of pressure is effected, the existence of any ridges in this area would cause alterations in the check valve seat (6) due to its elasticity, and this would affect the sealing characteristics of the check valve. As shown in the attached drawings and particularly FIGS. 4 and 6, three ridges (4) are distributed in the upper part of the body (1), having in mind to increase friction with the inner surface of the bottle top, and there is a single ridge (4') in the lower part of the body (1) which not only will increase friction but will also cause sealing and avoid the flow of liquid between the inner surface of the bottle top and outer surface of the body (1).

The seat (6) of the check valve (16) is placed approximately half way between the upper and lower brims of the body (1) and is integral with the lateral surface of the body (1). The seat consists of an opening, preferably circular, formed by a septum (5) perpendicular to the wall of body (1). As shown more clearly in FIG. 4, the seat (6) of the check valve (16) is formed by an edge derived from a circular cleft (6'), the cleft being concentric with the circular opening. The cleft 6' affords elasticity to edge (6) and enables deformation to occur thereby allowing a perfect sealing of the check valve 16, for example if an attempt is made to add adulterated liquid into the bottle.

The thickness of the septum 5 decreases in the direction of the wall of body 1, as a result of the existence of a depression (6'') bordered on the side of the seat (6) by a surface with a 45° slant, the object of which is to deflect the lines of flow of a liquid which are introduced through the opening of pourer 10, thereby to deflect them from the walls 17' of the check valve 16, avoiding displacement of the check valve from the seat. The septum 5 forms the base of a chamber 7 which houses the pourer 10 which is located by means of insertion and encasing. The pourer is illustrated more clearly in FIGS. 8 to 10. The inner surface of chamber 7 is slightly frusto-conical to avoid removal of the pourer after the valve unit has been inserted in the neck of a bottle. The pourer 10 is held even more tightly as a result of contraction of the valve unit when it has been introduced in a bottles neck. The inner diameter 7' at the base of the chamber 7 is accordingly slightly greater than the diameter 7'' of the chamber 7 the mouth of the bottle (FIG. 5).

An annular guide (9) for the lower stem (18) of the check valve (16) is integrally attached to the lower surface of the septum 5 and to the side wall (2) of body (1) by four septa (8) which are radially disposed. The guide (9) is coaxial with the longitudinal axis of body 1 and the lower stem (18) of the check valve (16) is slidably fitted in the annular guide, as shown in FIG. 4.

The body 1 with all its aforementioned components is intended to be sold as one single item made of a material which is sufficiently elastic to give the desired properties. The body is preferably made of low density polyethylene, for example by injected molding methods.

The pourer (10), as shown in FIGS. 8 to 10 and also in the assembly shown in FIG. 4, serves as a guide for the upper stem (19) of the check valve (16) and also provides a uniform flow without turbulence of the liquid contained in the bottle. The rate of flow is such that the individual dose of the alcoholic beverage usually served may be poured within a reasonable space of time. The pourer (10) also serves as an upper stop for the check valve (16) when the latter moves from the seat (6,6') when the bottle is tilted and the liquid contained in the bottle exerts pressure on the check valve.

The outer shape of the pourer (10) is frusto-conical and tapers towards the upper end of the pourer. A lower portion (11) of the pourer is also frusto-conical but tapers in an opposite sense towards the bottom of the pourer in order to facilitate the introduction and encasing of the pourer in chamber (7) of the body (1). There are four ridges or septa (12) radially arranged within the pourer; these reinforce the pourer and support a concentric cylindrical wall (13) having an outer diameter which is the same as that of the plate (17) of the check valve (16). Extending radially inwardly from the wall (13) to an adequate distance from the longitudinal axis of the pourer are four guide ridges (14) for guiding the movement of the upper stem (19) of the check valve.

The cylindrical wall (13) extends upwardly to then form an inverted bowl-shaped portion by means of a frusto-conical surface 15, which forms a surface for deflecting the flow of liquid ending in a flat surface (15') at the same level as the upper edge of the pourer.

In this manner the cylindrical wall (13), the frusto-conical surface (15) and the upper part (15') form a chamber which houses the guide ridges (14) and which fully accommodates the upper stem (19) of the check valve (16) when the check valve is displaced by pressure of the liquid on tilting the bottle, causing the upper surface of the plate (17) of the check valve (16) to abut against the lower edge of the cylindrical wall (13), as shown in FIG. (14).

It will therefore be seen that the aforementioned pourer (10), when the check valve is fully raised, as seen in FIG. 14, that is, fully opened, the geometric form of the lower surface of the plate of the check valve (16), is complementary with the cylindrical wall (13) and the frusto-conical surface (15) of the pourer, thus creating a flow path, indicated by the arrows in FIG. 14, which has no obstructions thereby allowing liquid to flow out of the bottle without turbulence.

It should be noted that owing to the specific geometry of the valve, a narrowing of the flow path occurs in passing from the cylindrical wall (13) to the frusto-conical zone (15). This causes a higher speed when pouring the liquid, thus causing a squirt directed forwardly of the bottle, avoiding the formation of accretions around the bottle. This feature of the invention is very important, so that a reasonable flow of liquid may be poured from the bottle in a practical and easy manner.

The check valve (16) shown in FIGS. 11 to 13 consists of a circular plate (17), shaped as shown in the drawings, having a double frusto-conical profile (i.e. with generatrices of different slope). The maximum diameter of the plate, i.e. the diameter of the upper edge of the plate is the same as the outer diameter of the cylindrical wall (13) of the pourer, so that a perfect engagement between the plate 17 and the wall 13 may be obtained when the valve raises fully when the bottle is tilted in order to extract liquid therefrom (see FIG. 14). The generatrix (17') of the first frusto-conical zone of the plate (17) is of such a slope that the distance from this generatrix to the edge of the seat (6) in body 1 and that between the outer surface of the cylindrical wall (13) of the pourer and the inner surface of the wall (10) of the pourer is the same when the check valve is fully raised. This avoids strangulation or turbulence during withdrawal of liquid from the bottle.

The slope of the frusto-conical upper zone (17'') is such as to give a perfect seal on the edge of the seat (6) of the body. The check valve (16) has a lower cylindrical guide stem (18) which is slidably engaged in annular guide (9). The stem (18) is long enough to lower the center of gravity of the check valve, so that the latter may have a maximum tendency to lower itself once the inclination of the bottle is reduced after withdrawal of the liquid. This feature of the invention is very important in order to render practically impossible the introduction of any liquid into the bottle.

For the same purpose, the stem of the upper guide (19) of the valve, which is guided by the edges of guides 14 of the pourer, is frusto-conical, and tapers upwardly, its length being determined exactly by the required displacement of the valve as may be seen in FIG. 14. With such an arrangement the desired guided movement of the valve, which is essential for the good functioning of the unit, is obtained.

The plate of the check valve also has a inner frusto-conical zone (20), so as to form a basin, the object of which is to lessen the weight of the valve, to assist in lowering the center of gravity of the valve for the reason already mentioned, and moreover to increase the surface subject to the pressure of a liquid which may be fraudulently intended to be introduced into the bottle, which offers an added barrier.

Both the pourer and the check valve must be, according to this invention, made of a rigid plastic material capable of withstanding deformations of the body (1) on being introduced into the neck of the bottle. Polystyrene is an appropriate material for this effect although other materials of adequate characteristics may be used if they permit the manufacture of the parts by injection molding.

Although described in detail the parts comprising the valve unit of this invention and its mode of operation, it is evident that numerous alterations of detail and in the choice of materials, clear to experts of this matter, are possible while not dectrating from the scope of the invention.

We claim:

1. A non-return valve for a bottle comprising:

a tubular insert for insertion within the neck of said bottle, said tubular insert including a transverse septum having a circular opening therein and guide means disposed along the underside of said opening;

a check valve, said check valve being conical in configuration with the narrowest portion of the valve extending downwardly for releasable engagement with said circular opening in said septum, said check valve including upper and lower extensions, said lower extension being engagable with said guide means in said circular opening to permit said check valve to be slidably displaced into and out of said opening in said septum by the action of gravity, said check valve blocking said circular opening when said bottle is upright;

pouring means, disposed within the upper portion of said tubular insert, said pouring means including a circular aperture therein at the upper portion thereof, a conical plug disposed in said opening, said conical plug having its widest portion disposed at its lower end, said plug being spaced apart from said aperture to provide a generally annular aperture for fluid passage thereabout, guide means disposed along the underside of said plug for engagement with the upper extension on said plug to permit sliding movement of said check valve, the upper portion of said check valve being engagable with the underside of said plug to provide a smooth flow of liquid around said check valve and said plug when said check valve is displaced toward said plug when said bottle is inverted.

2. The valve as claimed in claim 1 wherein the conical portion of said check valve is concave at its upper, widest portion to permit the firm seating of said check valve in said opening by fluid pressure when said check valve is seated in said opening.

3. The check valve as claimed in claim 1 wherein said non-return valve includes transverse ridges extending around said tubular insert for firm engagement with said neck of said bottle.

4. A check valve as claimed in claim 3 wherein said ridges are located above the position of said septum so that the engagement of said ridges with said bottleneck will not displace the septum and said check valve.

5. The valve as claimed in claim 1 wherein said tubular insert further includes a transversely extending brim along its uppermost portion to extend over the top of said bottle to facilitate fluid flow therefrom.

6. A non-return valve as claimed in claim 1 wherein said tubular insert is slightly frusto-conical in shape to facilitate insertion of said tubular insert in said bottleneck.

7. The valve as claimed in claim 1 wherein said pouring means including a tubular portion for insertion within said tubular insert.

* * * * *